US005466075A

United States Patent [19]

Kouzai et al.

[11] Patent Number: 5,466,075

[45] Date of Patent: Nov. 14, 1995

[54] COLOR THERMAL PRINTER

[75] Inventors: Fumio Kouzai; Susumu Tokumaru; Syozo Kitamura, all of Hiroshima, Japan

[73] Assignee: Mitsubishi Denki Kabushiki Kaisha, Tokyo, Japan

[21] Appl. No.: 275,421

[22] Filed: Jul. 15, 1994

[30] Foreign Application Priority Data

Nov. 30, 1993 [JP] Japan ..... 5-300035

[51] Int. Cl.[6] ..... B41J 33/51

[52] U.S. Cl. ..... 400/240.3; 400/120.02; 400/240

[58] Field of Search ..... 400/240.3, 240.4, 400/120.04, 239, 240, 120.02

[56] References Cited

U.S. PATENT DOCUMENTS

| | | | |
|---|---|---|---|
| 5,037,218 | 8/1991 | Shimizu | 400/120.04 |
| 5,132,701 | 7/1992 | Stephenson | 400/240.3 |
| 5,185,315 | 2/1993 | Sparer | 400/240.3 |

FOREIGN PATENT DOCUMENTS

| | | | |
|---|---|---|---|
| 64-5879 | 1/1989 | Japan | 400/240 |
| 1204778 | 8/1989 | Japan | 400/240 |
| 4146186 | 5/1992 | Japan | 400/240 |
| 4351583 | 12/1992 | Japan | 400/240 |
| 4357069 | 12/1992 | Japan | 400/240 |

*Primary Examiner*—Edgar S. Burr
*Assistant Examiner*—Steven S. Kelley
*Attorney, Agent, or Firm*—Sughrue, Mion, Zinn, Macpeak & Seas; Richard C. Turner; John J. Penny, Jr.

[57] ABSTRACT

A color thermal printer using an ink sheet having a set of three or four colorants coated or printed so as to correspond to a print area with sensor marks arranged at boundaries between the colorants. In the color thermal printer, a plurality of sensors are disposed within a print width of a thermal head and downstream from a heat line of the thermal head in an ink sheet forward direction by a predetermined distance. When the sensors have sensed the sensor marks, the ink sheet is rewound by the predetermined distance to cause the printing operation to be effected.

13 Claims, 10 Drawing Sheets

| INK COLOR \ SENSOR | INFRARED LIGHT | RED LIGHT | GREEN LIGHT |
|---|---|---|---|
| Y | 0 | 0 | 0 |
| M | 0 | 0 | 1 |
| C | 0 | 1 | 0 |
| BK | 0 | 1 | 1 |
| SENSOR MARK | 1 | 1 | 1 |

0 : LIGHT IS TRANSMITTED
1 : LIGHT IS SHIELDED

0 : LIGHT IS TRANSMITTED

1 : LIGHT IS SHIELDED

COLOR THERMAL PRINTER

BACKGROUND OF THE INVENTION

The invention relates to a color thermal printer.

FIG. 13 is a diagram showing a main portion of a construction of a conventional color thermal printer disclosed in, e.g., Japanese Patent Unexamined Publication No. Sho. 64-5879; and FIG. 14 is a diagram showing an ink sheet. In FIGS. 13 and 14, reference numeral 1 designates a platen; 2, a thermal head mounted on a radiating plate 2*a* and having a linearly formed heating body; 3, a print sheet; and 4, an ink sheet. The ink sheet 4 is prepared by coating or printing three (3) colorants, namely, yellow (Y) 4*b*, magenta (M) 4*c*, cyan (C) 4*d*, on a base film 4*a* in succession so as to correspond respectively to a print area. An ink sheet having four (4) colorants including black (BK) 4*e* is also available. A head color mark 4*f* for allowing the head color of each set to be sensed and an identification mark (ID mark) 4*g* for aligning each color with a print start position and for identifying the type of ink sheet are arranged. The head color mark 4*f* and the ID mark 4*g* are sensor marks. The head color mark 4*f* and the ID mark 4*g*, which are sensor marks, are coated with a highly light-shielding paint. Reference numeral 5 designates an ink sheet feed roll; 6, an ink sheet take-up roll; and 7, a sensor for sensing light-shielding at the sensor marks.

An operation of the printer will be described next. Almost simultaneously with the print sheet 3 having been forwarded to the print start position, the ink sheet 4 is also forwarded toward the ink sheet take-up roll 6 from the ink sheet feed roll 5. At this instance, the head color mark 4*f* is sensed by the sensor 7 and the forwarding of the ink sheet 4 is thus stopped. The platen 1 is rotated at a predetermined speed by applying an electric signal corresponding to an image to the thermal head 2 with the print sheet 3 and the ink sheet 4 interposed between the platen 1 and the thermal head 2, and under this condition, the colorant, yellow 4*b*, is thermally transferred onto the print sheet 3 first. Then, the thermal head 2 is moved away from the platen 1 and the print sheet 3 is returned to the print start position, and at the same time, the ink sheet 4 is forwarded to the next color. The forwarding of the ink sheet 4 is stopped when the ID mark 4*g* has been sensed by the sensor 7 in the course of forwarding, and the thermal head 2 is caused to abut against the platen 1 to start printing the next colorant (magenta 4*c*) on the print sheet 3. The colorants, cyan 4*d* and black 4*e*, are similarly thermally transferred to complete the printing.

The conventional color thermal printer and the ink sheet are constructed as described above. The sensor 7 is disposed within a print width of the thermal head 2 since the head color marks 4*f* and the ID marks 4*g* are arranged at the boundaries between the colorants. While it is desirable to make the distance between the heat line of the thermal head 2 and the sensor 7 as short as possible, a distance L is by all means required since the radiating plate 2*a* and a guide roller (no reference numeral is designated) are in the way. As a result, the distance L from the head color mark 4*f* or the ID mark 4*g* sensed by the sensor 7 to a colorant to be used for printing becomes a wasteful portion on the ink sheet 4, thus making the outer diameters of the ink sheet feed roll 5 and the ink sheet take-up roll 6 large.

FIG. 15 is a diagram showing the relationship between the ink sheet and the sensor in another conventional example disclosed in, e.g., Japanese Patent Unexamined Publication No. Sho. 64-5879. In FIG. 15, reference characters 4 and 4*a* to 4*g* designate the same parts and components as those described above. Since the head color mark 4*f* and the ID mark 4*g* are arranged out of the print width of the thermal head 2 in the second conventional example, the print start position can be close to the boundary of each colorant by interposing only a distance L between the sensor 7 and the boundary of each colorant, thus producing no such waste as the distance L in the first conventional example. However, since the sensor 7 is disposed outside the print width of the thermal head 2, the ink sheet 4 must include such margins as to allow the head color marks 4*f* and the ID marks 4*g* to be therein arranged in addition to a width W1 of the colorant, which makes the width of the ink sheet 4 as wide as W2 (W1<W2).

Although it depends on how the head color marks 4*f* and the ID marks 4*g* are arranged on the ink sheet 4 and on how the sensor 7 is disposed in the printer, the thus constructed conventional color thermal printers have to accommodate either an ink sheet roll whose outer diameter is large or an ink sheet roll whose width in the axial direction is large, which has been a hindrance to downsizing color thermal printers.

SUMMARY OF THE INVENTION

The invention has been made to overcome the above problem. Accordingly, an object of the invention is to provide a downsized color thermal printer by using an ink sheet whose length and width are so minimal as to allow the printer to be downsized.

In order to attain the above object, the invention provides a color thermal printer using an ink sheet having a set of three or four colorants coated or printed so as to correspond to a print area with sensor marks arranged at boundaries between the colorants, the color thermal printer including: a plurality of sensors, disposed within a print width of a thermal head and downstream from a heat line of the thermal head in an ink sheet forward direction by a predetermined distance, for sensing the sensor marks; and means for rewinding the ink sheet by the predetermined distance when the sensors have sensed the sensor marks and then causing printing to be effected.

The color thermal printer according to the invention is designed to cause printing to be effected by rewinding the ink sheet by the predetermined distance when the sensors have sensed the sensor marks. Therefore, such waste as the predetermined distance of the ink sheet between the heat line of the thermal head and the sensors can be eliminated.

BRIEF DESCRIPTION OF THE DRAWINGS

The accompanying drawings, which are incorporated in and constitute a part of this specification, illustrate embodiments of the invention and, together with the description, serve to explain the objects, advantages and principles of the invention. In the drawings.

DETAILED DESCRIPTION OF THE PREFERRED EMBODIMENTS

Figure 1:
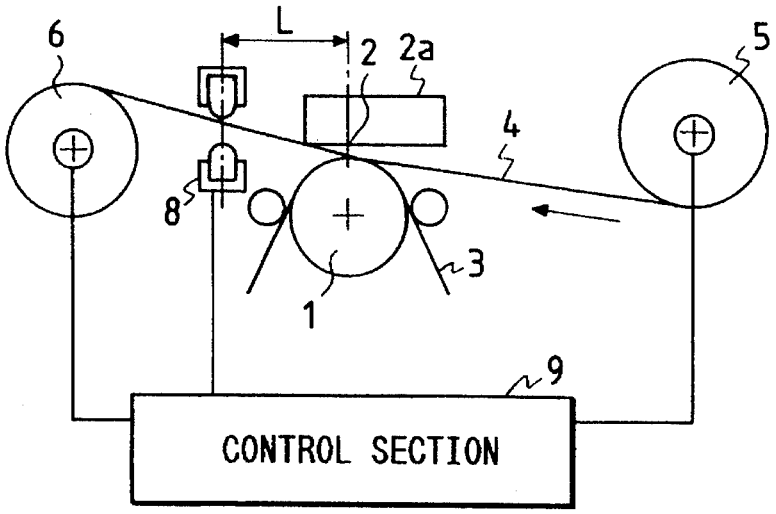
FIG. 1 is a diagram showing a main portion of a construction of a color thermal printer according to a first embodiment of the invention.
Figure 2:
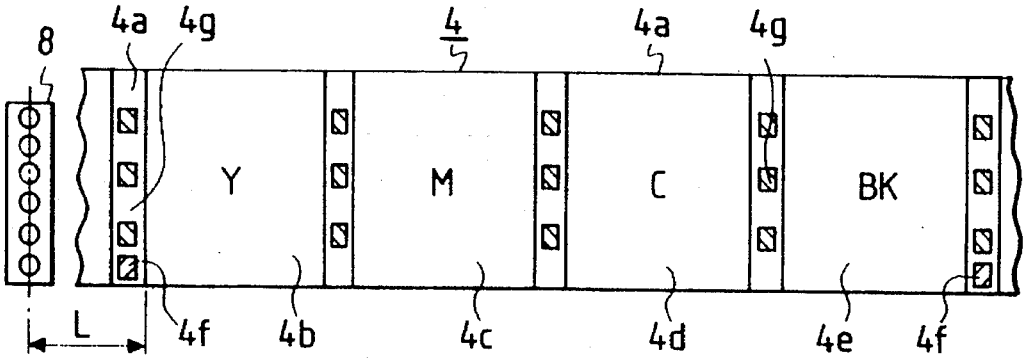
FIG. 2 is a diagram showing an ink sheet in the first embodiment of the invention.

FIG. 1 is a diagram showing a main portion of a construction of a color thermal printer according to a first embodiment of the invention; and FIG. 2 is a diagram of an ink sheet. In FIGS. 1 and 2, reference characters 1 to 6 and 4*a* to 4*g* designate the same parts and components of the conventional examples. In this embodiment, such an ink sheet as having a head color mark 4*f* and an identification mark (ID mark) 4*g* that identifies the division of colors at a boundary between colors is used. The ID mark 4*g* has a recognition pattern that is formed of a combination of a plurality of light-shielding portions and light-transmitting portions so that not only the head of each color can be sensed but also the type of ink sheet (three colors, four colors, print area size, sublimated ink, molten ink, or the like) can be identified simultaneously. The ID marks 4*g* of the same pattern are arranged at the boundaries between colors within a roll of ink sheet. Generally, the boundaries separate colorants from one another by leaving transparent portions on a base film 4*a* with no colorants coated for a predetermined width to prevent mixture of the colorants. Each ID mark 4*g* is therefore arranged on a part of the transparent portion.

Reference numeral 8 designates a sensor block in which a plurality of sensors are arranged in a row. The row of sensors is arranged in substantially parallel with a heating body line of a thermal head 2 that is downstream in the printing process. The thermal head 2 and the sensing point of the sensor block 8 are apart from each other by a distance L. Reference numeral 9 designates a control section, which controls not only rotation of a platen 1 and printing by the thermal head 2, but also drive motors (not shown) of an ink sheet feed roll 5 and an ink sheet take-up roll 6 in response to recognition signals from sensors of the sensor block 8 in this embodiment.

Figure 3:
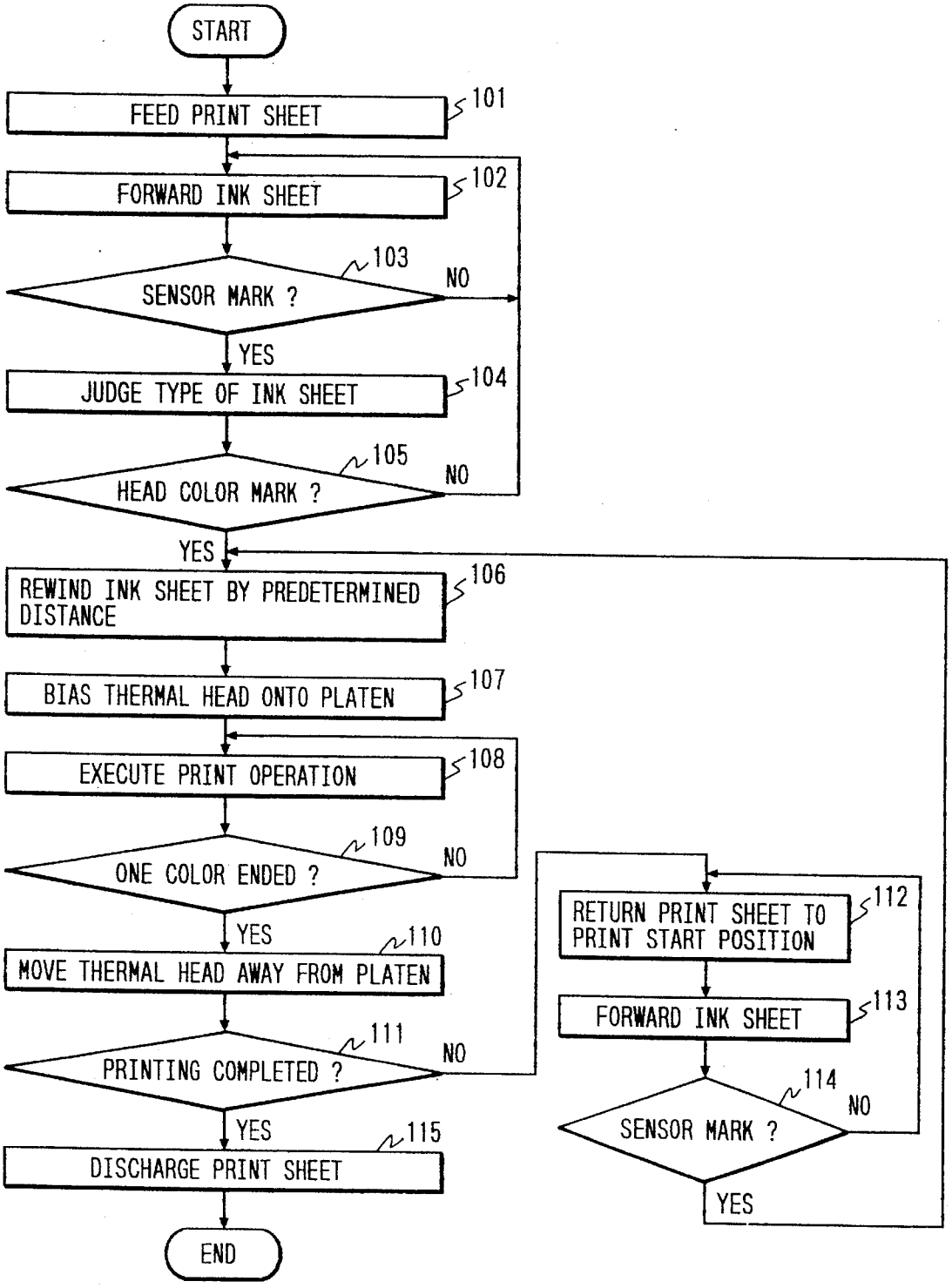
FIG. 3 is a flowchart illustrative of an operation of the first embodiment of the invention.

An operation of this embodiment will be described with reference to a control flow shown in FIG. 3. A print sheet 3 is fed to a print start position by an image print start command (Step 101). Almost simultaneously therewith, an ink sheet 4 is also forwarded up to a position where the sensors of the sensor block 8 sense an ID mark 4*g* and stopped thereat (Steps 102 and 103). A type of ink sheet 4 on which to effect printing is judged from the ID mark 4*g*, and a print execution sequence, a control parameter and the like are then selected (Step 104). If a head color mark 4*f* is sensed simultaneously therewith, a next step is executed, if not, the ink sheet 4 is forwarded until a head color mark 4*f* is sensed (Step 105). Since the sensor block 8 for sensing the head color mark 4*f* or the ID mark 4*g* is apart from the heating body line of the thermal head 2 by the distance L, the ink sheet 4 is rewound by the distance L (Step 106) so that the head of a colorant, yellow 4*b*, coincides with the heating body position of the thermal head 2 to thereby execute printing (Steps 107 and 108).

When printing of the first color (yellow) has been ended, the print sheet 3 is moved to the print start position, and the ink sheet 4 is forwarded (Steps 109 to 113). When the ID mark 4*g* of a next color has been sensed by the sensors of the sensor block 8 (Step 114), the forwarding operation is stopped. The ink sheet 4 is then rewound by the distance L (Step 106), and printing of the second color (magenta) is effected. In a similar manner, the third color (cyan) and the fourth color (black) are printed to complete the printing operation.

Since the first embodiment of the invention is designed as described above, there is no wasteful distance L between the thermal head 2 and the sensing point of the sensor block 8 at each colorant-coated portion on the ink sheet 4, thereby contributing to decreasing the ink sheet roll diameter.

Figures 4, 5:
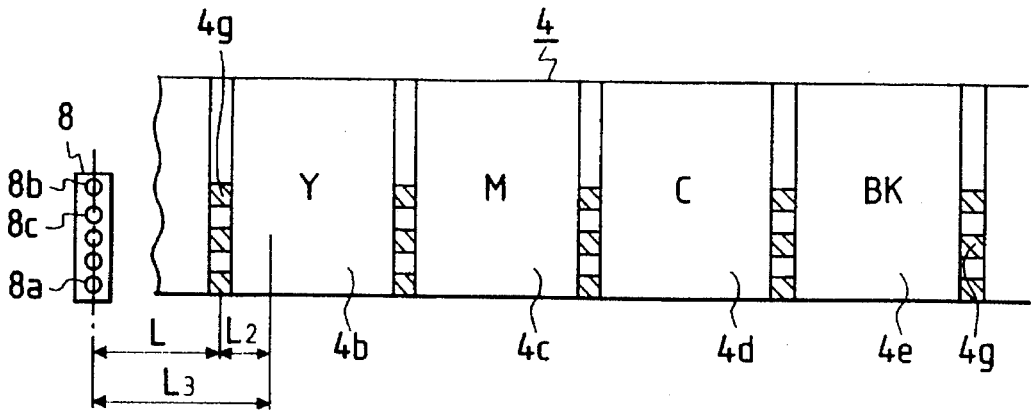
FIG. 4 is a diagram showing a relationship between an ink sheet and sensors of a second embodiment of the invention.
FIG. 5 is a diagram showing a truth table of the light-shielding characteristics by the ink colorant and the type of sensor.
Figure 6:
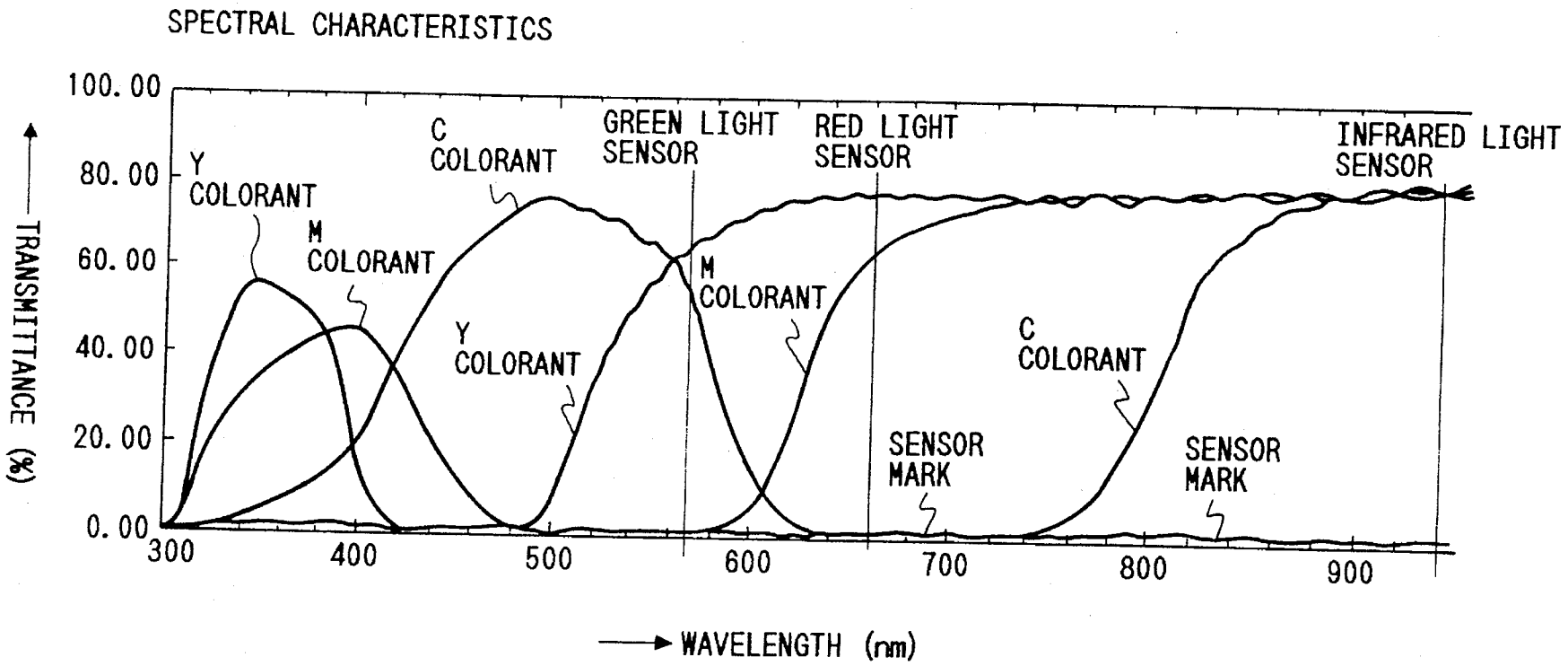
FIG. 6 is a graph showing spectral characteristics of colorants of an ink sheet.
Figure 7:
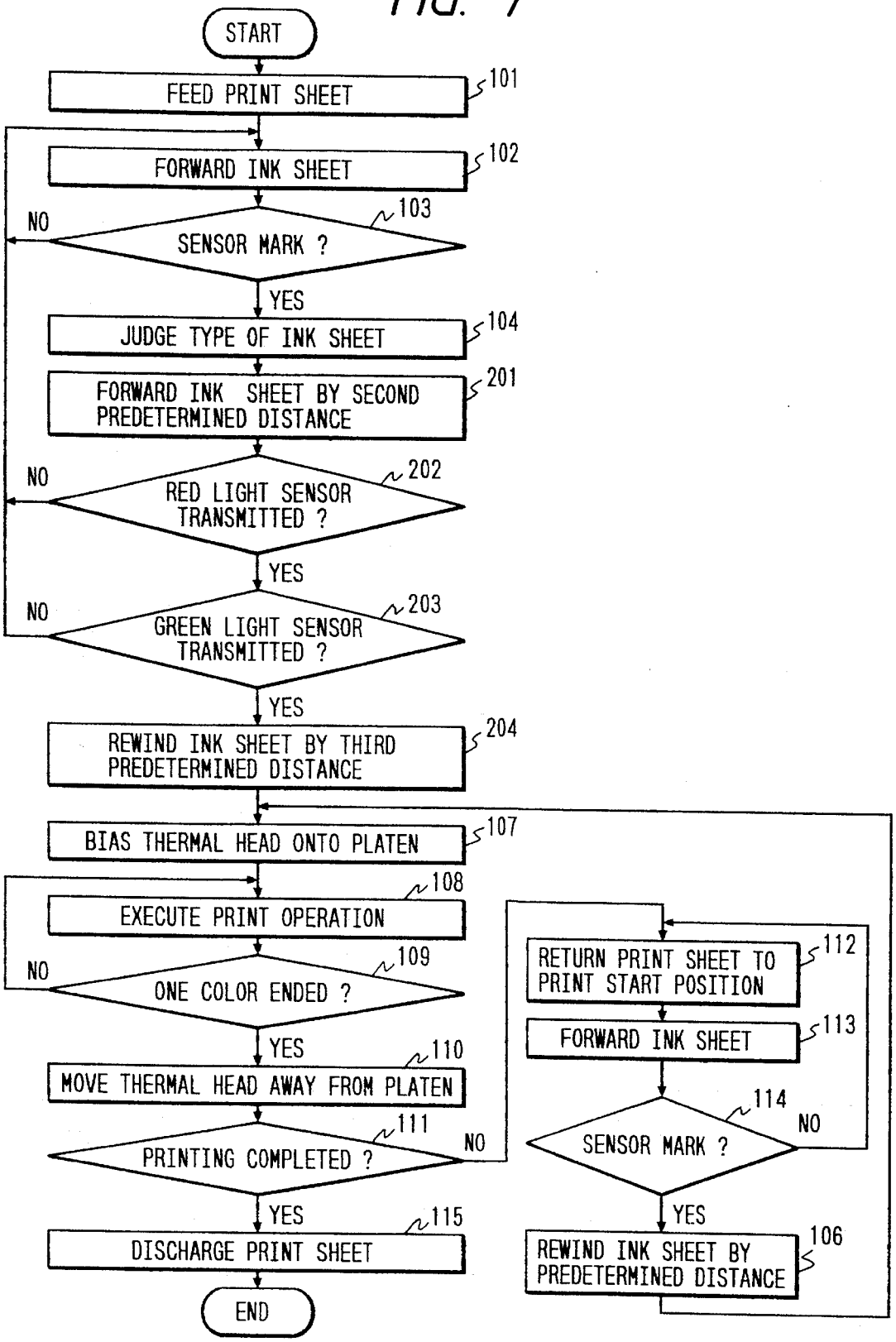
FIG. 7 is a flowchart illustrative of an operation of the second embodiment of the invention.

FIG. 4 is a diagram showing the relationship between the ink sheet and the sensors of a second embodiment of the invention; FIG. 5 is a diagram showing a truth table of light-shielding characteristics by the types of ink colorants and sensors; FIG. 6 is a graph showing spectral characteristics of the respective colorants on the ink sheet, in which the transmittance is indicated in function of the wavelength of each color with the axis of ordinate showing the transmittance, and the axis of abscissa showing the wavelength of light; and FIG. 7 is a flowchart illustrative of a control flow of an operation of the second embodiment. In FIGS. 4 to 7, reference characters 4, 4*a* to 4*e*, 4*g*, and 8 designate the same parts and components as those of the first embodiment.

At the boundaries of the respective colorants on the ink sheet 4 are ID marks 4*g*; there are no head color marks. Reference character 8*a* designates a red light sensor; 8*b*, green light sensor; and 8*c*, an infrared light sensor. As shown in FIG. 6, the light-shielding rate of the red light sensor 8*a* is high for cyan and black, but low for yellow and magenta. The light-shielding rate of the green light sensor 8*b* is high for magenta and black, but low for yellow and cyan. The infrared light sensor 8*c* does not shield light at portions other than the sensor marks. This relationship can be expressed in a truth table shown in FIG. 5. When both the red light sensor 8*a* and the green light sensor 8*b* receive a light-transmitting signal, the head color, which is yellow, is able to be detected. Since the light of the red light sensor 8*a* and that of the green light sensor 8*b* are shielded by a sensor mark at a boundary between colorants and the light is naturally transmitted by a transparent portion where no sensor mark is coated, the combination of such sensing results can be shared as the identification bits of the ID mark 4*g*.

An operation control flow of the second embodiment of the invention will be described with reference to FIG. 7. The same functions as in the first embodiment are designated by the same step numbers as those of FIG. 3. Since the steps from the print sheet feed operation (Step 101) to the ink sheet type judging operation (Step 104) are the same as those of the first embodiment, descriptions thereof will be omitted. Upon sensing of an ID mark 4*g* at the sensor block 8 position, the ink sheet 4 is further forwarded by a second predetermined distance L2 (Step 201) and the signals of the red light sensor 8*a* and the green light sensor 8*b* are checked. If either the red light sensor 8*a* or the green light sensor 8*b* outputs a light-shielding signal, then the colorant right below the sensor block 8 is judged to be a colorant other than yellow, so that the same operation is repeated until the head color, yellow, is sensed. When both light sensors 8*a* and 8*b* output light-transmitting signals, the head color, yellow, is sensed (Steps 202 and 203).

When the colorant right below the sensor block 8 has been sensed as yellow, the ink sheet 4 is rewound by a third predetermined distance L3=L+L2 (Step 204) to cause the head of the colorant, yellow 4*b*, to coincide with the position of the heating body of the thermal head 2 and to effect printing (Steps 107 and 108). Since the subsequent steps are the same as those of the first embodiment, descriptions thereof will be omitted.

As a result of the above construction and control operation, a sensor dedicated to reading the head color mark 4*f* can be dispensed with. This makes it unnecessary to increase the number of sensors even if the number of ink sheet types is increased to thereby increase the number of recognition bits used for the ID mark 4*g*. Further, the head color mark 4*f* is no longer necessary for the ink sheet, which leaves only the ID mark of a single pattern as the sensor mark arranged at every boundary between colorants, thereby contributing to simplifying the ink sheet manufacturing process.

Figure 8:
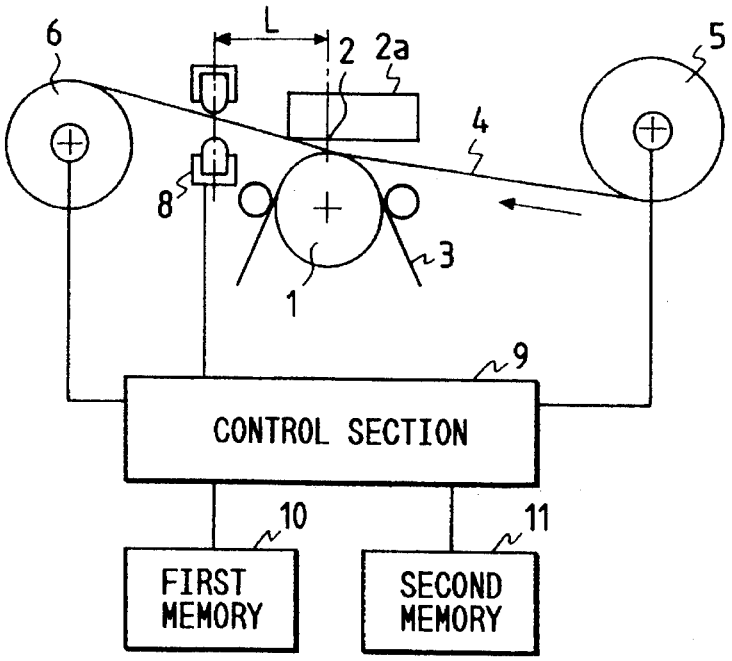
FIG. 8 is a diagram showing a main portion of a construction of a color thermal printer according to a third embodiment of the invention.
Figure 9:
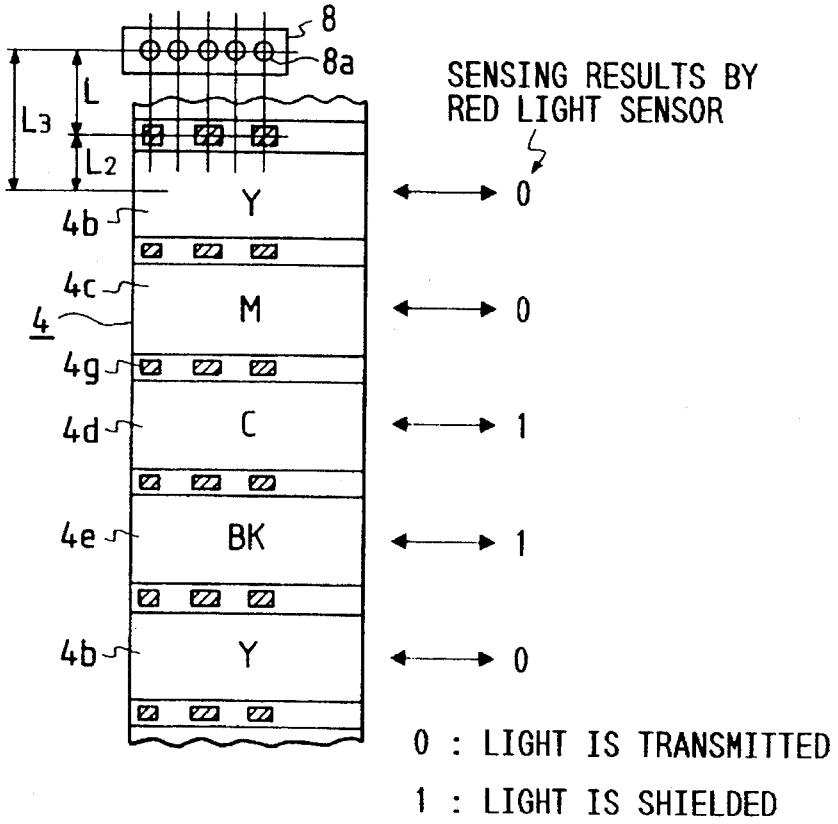
FIG. 9 is a diagram showing a relationship between an ink sheet and a red light sensor.
Figure 10:
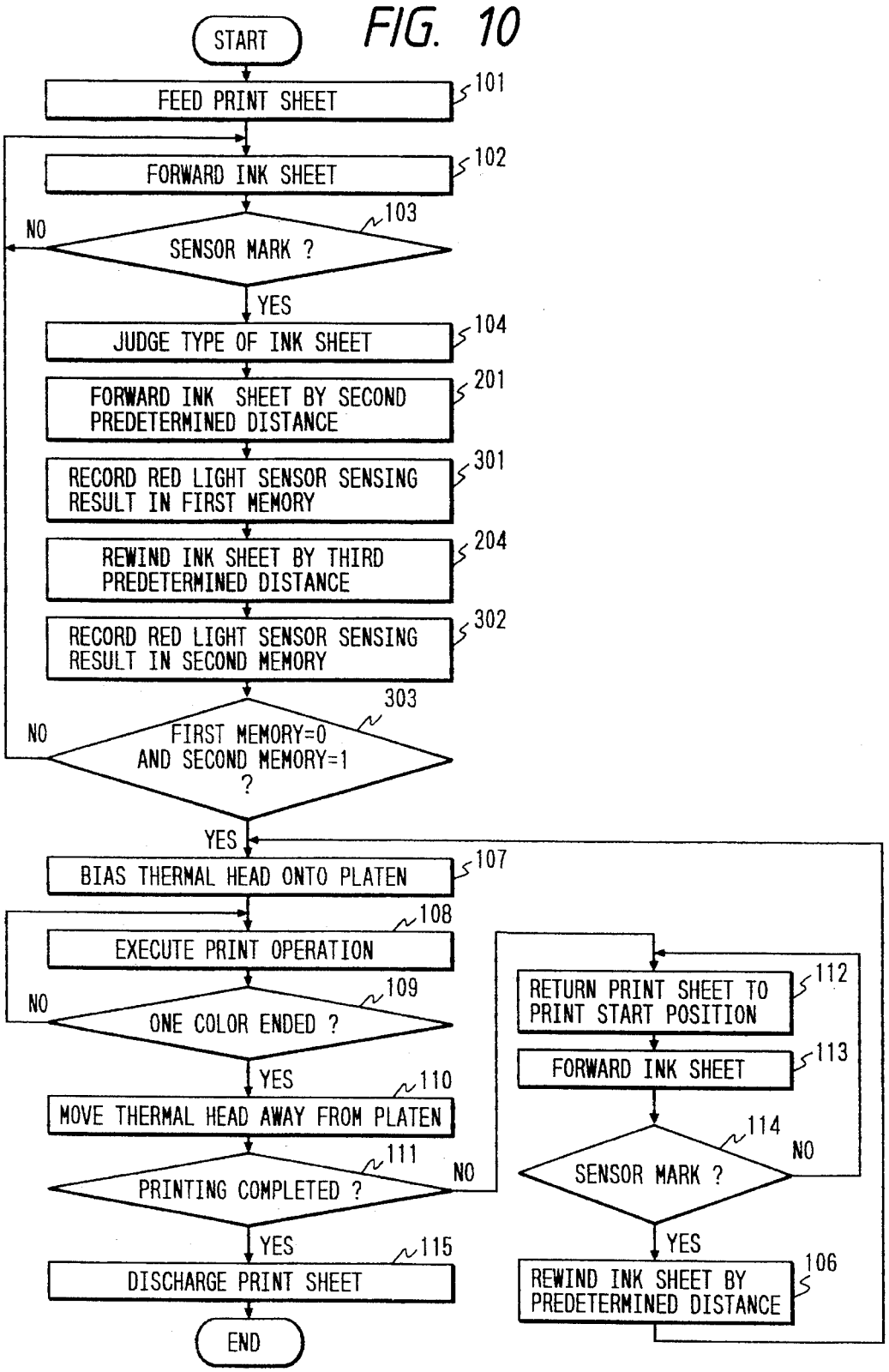
FIG. 10 is a flowchart illustrative of an operation of the third embodiment of the invention.

While the red light sensor 8*a* and the green light sensor 8*b* are used to sense the head color (yellow) in the second embodiment, a third embodiment of the invention is designed to sense the head color (yellow) only by the red light sensor 8*a*. FIG. 8 is a diagram showing a main portion of a construction of a color thermal printer according to the third embodiment of the invention; FIG. 9 is a diagram showing the relationship between the ink sheet and the sensing of the red light sensor; and FIG. 10 is a flowchart illustrative of a operation control flow of the third embodiment. In FIGS. 8 to 10, reference characters 1 to 9, 4*a* to 4*e*, and 4*g* designate the same parts and components as those of the first embodiment; and 10 and 11, a first memory and a second memory connected to a control section 9.

An operation control flow of the third embodiment of the invention will be described with reference to FIG. 10. The ink sheet 4 is forwarded in a manner similar to that in the second embodiment, and the same functions are designated by the same step numbers as those of FIG. 7. The steps from the print sheet feed operation (Step 101) to the operation of forwarding the ink sheet 4 by the second predetermined distance L2 (Step 201) are the same as those of the second embodiment, so that descriptions thereof will be omitted.

The sensing result obtained by the red light sensor 8*a* at this position is stored in the first memory 10 (Step 301). The ink sheet 4 is then rewound by the third predetermined distance L3=L+L2 (Step 204). This is not only a position at which the head of a colorant on the ink sheet 4 coincides with the heating body of the thermal head 2, but also a position at which the red light sensor 8*a* of the sensor block 8 senses a colorant just before such colorant. The sensing result obtained by the red light sensor 8*a* at this position is stored in the second memory 11 (Step 302). If the first memory 10 stores "0" and the second memory 11 stores "1" ("0" means that light is transmitted, and "1" means that light is shielded), then the colorant on the ink sheet 4 at the heating body line of the thermal head 2 is judged yellow 4*b*.

The reason therefor will now be described. Colorants transmitting light of the red light sensor 8*a* are yellow 4*b* and magenta 4*c*, whereas the colorants shielding the light are cyan 4*d* and black 4*e*. The only combination that satisfies a requirement that the light be transmitted at the timing of storage in the first memory 10 and is shielded at the timing of storage in the second memory 11 is a combination of yellow 4*b* and black 4*e* for a four-color ink sheet. Also, the only combination that satisfies the same requirement for a three-color ink sheet is a combination of yellow 4*b* and cyan 4*d*. Therefore, the colorant, yellow 4*b*, can be sensed by selecting this condition. As a result of the above construction, the third embodiment of the invention can judge yellow, which is the head color, only by a single sensor, the red light sensor 8*a*.

In the first embodiment, it has been described that portions having no coating of colorant are arranged for a predetermined width to prevent mixture of colorants at the boundaries. This design is implemented for ink sheets with molten colorants. However, ink sheets of sublimated colorants, not exhibiting mixture of colorants, requires no interval between colorants, and therefore it is possible to fabricate ink sheets such as shown in FIG. 11.

Figure 11:
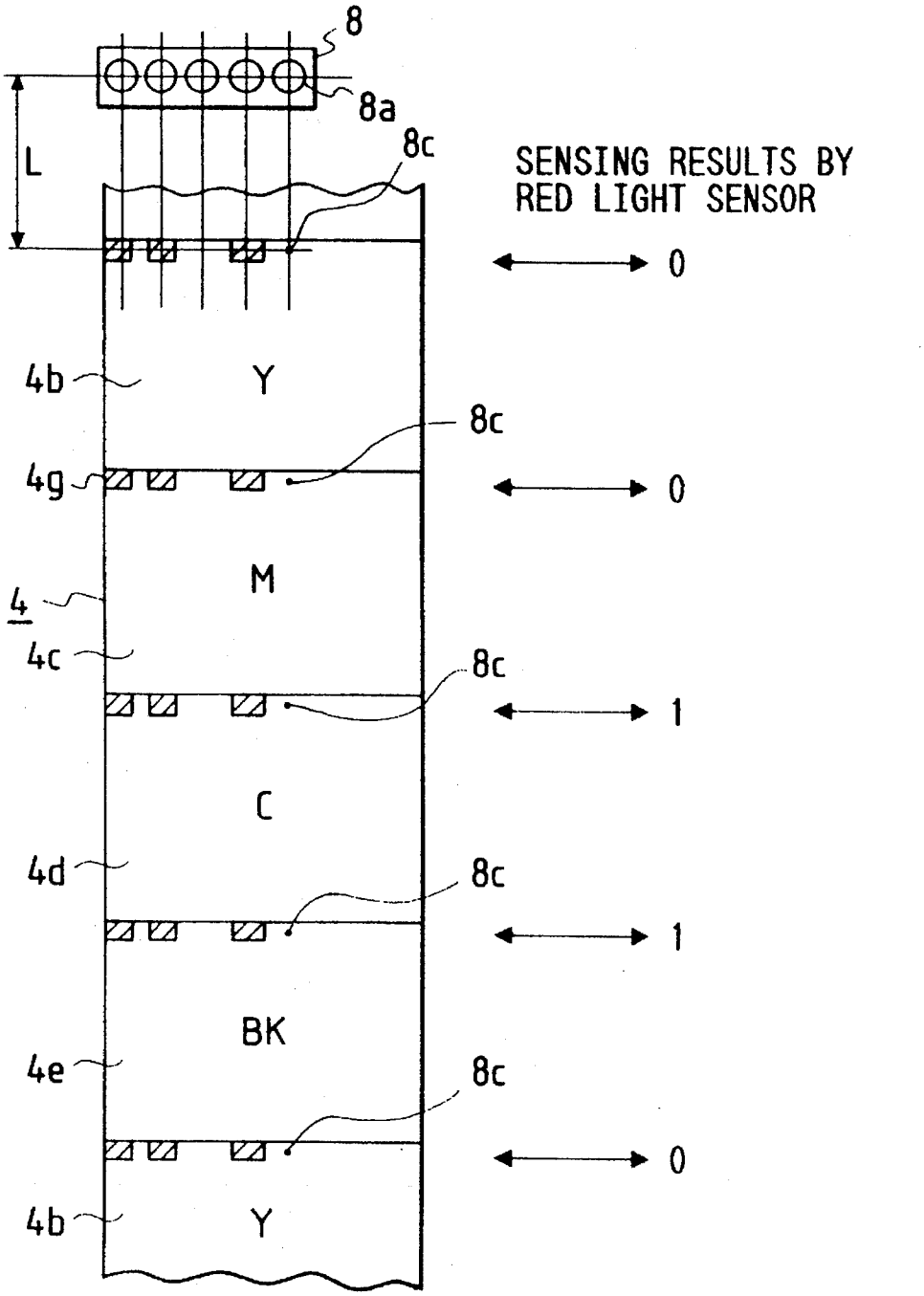
FIG. 11 is a diagram showing a relationship between the ink sheet and the sensing of the red light sensor in a fourth embodiment of the invention.

FIG. 11 is a diagram showing the relationship between the ink sheet and the sensing of the red light sensor in a fourth embodiment of the invention. A color thermal printer whose construction is the same in main portion as that of FIG. 8 is used. In FIG. 11, reference characters 4*a* to 4*e*, and 4*g* designate the same parts and components as those of the third embodiment. The ink sheet shown in FIG. 11 has a coating or printing of sublimated colorants, and there are no transparent portions at the boundaries between colorants. Each ID mark 4*g* is coated or printed so as to be superposed on each colorant at the head of the colorant.

Figure 12:
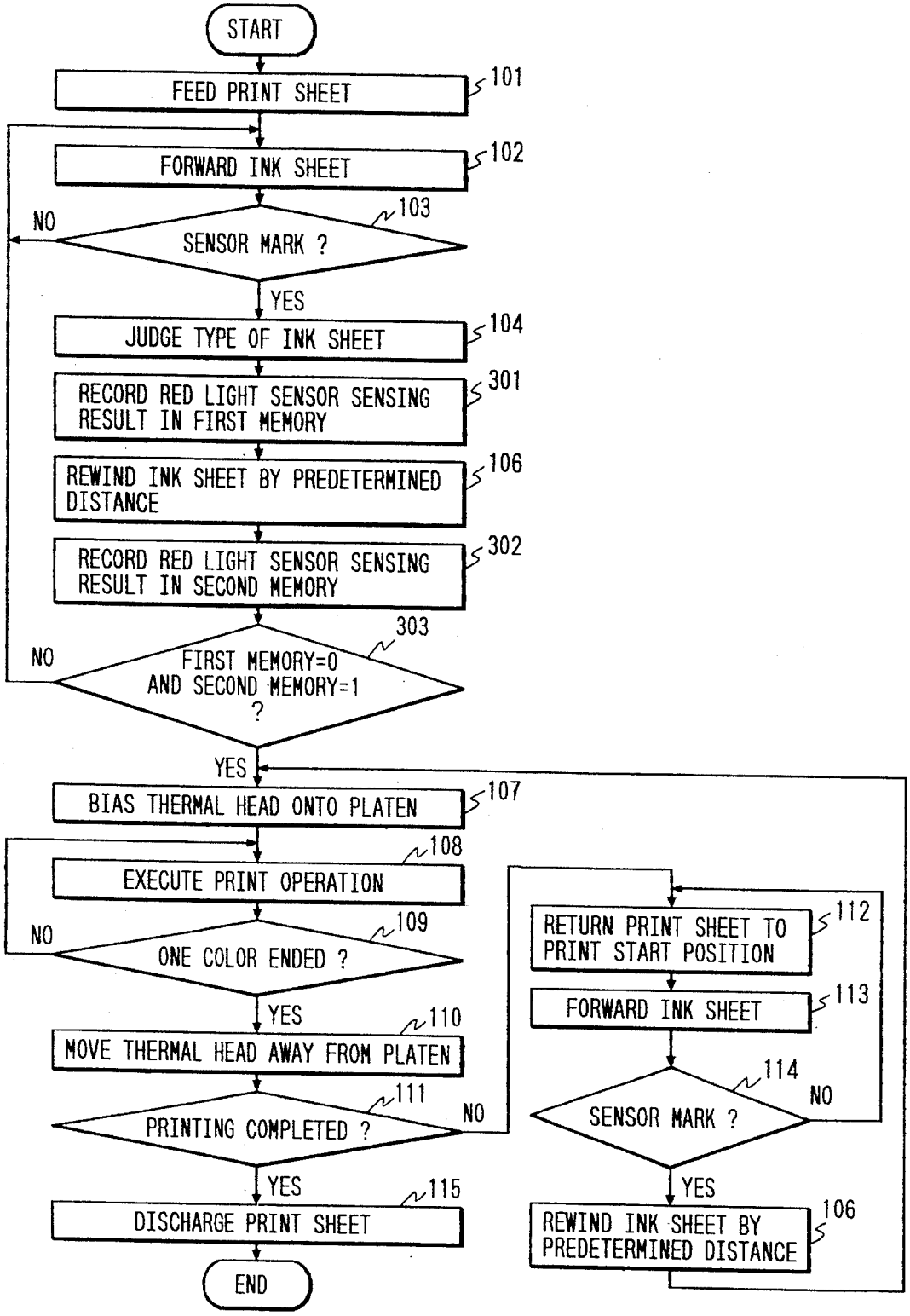
FIG. 12 is a flowchart illustrative of an operation of the fourth embodiment of the invention.
Figure 13:
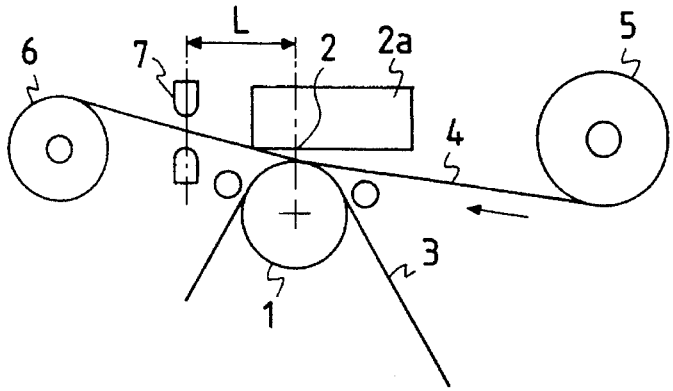
FIG. 13 PRIOR ART
FIG. 13 is a diagram showing a main portion of a construction of a conventional color thermal printer.
Figure 14:
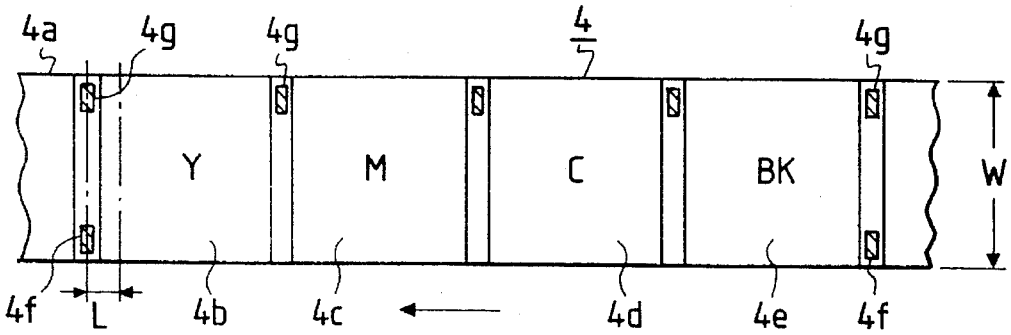
FIG. 14 PRIOR ART
FIG. 14 is a diagram of a conventional ink sheet.
Figure 15:
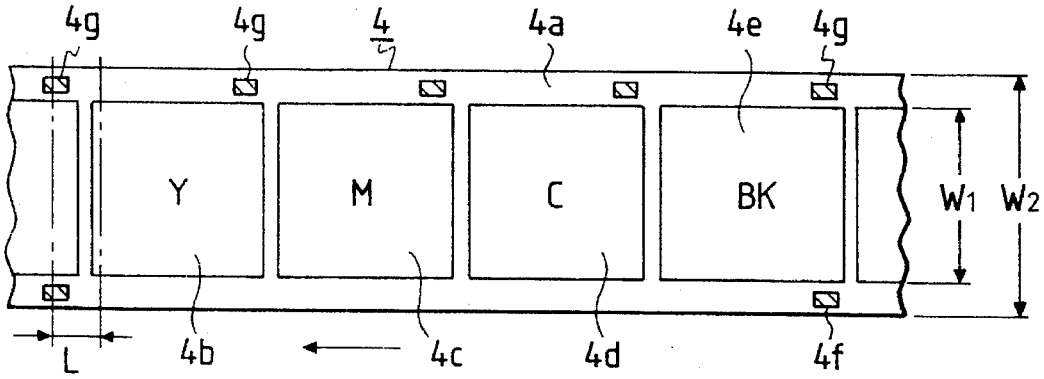
FIG. 15 PRIOR ART
FIG. 15 is a diagram of another conventional ink sheet.

FIG. 12 is a flowchart illustrative of an operation control flow of the fourth embodiment. The same functions are designated by the same step numbers as those of FIG. 10. The steps from the print sheet feed operation (Step 101) to the ink sheet 4 type judging operation (Step 104) are the same as those of the third embodiment, so that descriptions thereof will be omitted. As described above, the type of the ink sheet 4 is judged (Step 104) and the colorant sensing result obtained by the red light sensor 8*a* is stored in the first memory 10 (Step 301) simultaneously. Then, the ink sheet 4 is rewound by the predetermined distance L (Step 106) to cause the head of the colorant to coincide with the heating body line of the thermal head 2, and a sensing result obtained by the red light sensor 8*a* that has sensed a colorant at the sensor block 8 downstream from this position by the predetermined distance L is stored in the second memory 11 (Step 302). If a condition that the first memory 10 has "0", meaning that the colorant has transmitted the light and that the second memory 11 has "1", meaning that the colorant has shielded the light is satisfied (Step 303), the head colorant, yellow, is selected, which allows the printing operation to be started.

When the ink sheet of the fourth embodiment is used, the reading of an ID mark 4*g* and the sensing of light-shielding and light-transmission of a colorant using the red light sensor 8*a* can be effected at the same position, thereby making the forwarding of the ink sheet by the second predetermined distance L2 unnecessary and thereby allowing the operation to be simplified.

While the first to third embodiments are applicable to both molten and sublimated ink sheets, the fourth embodiment is applicable only to sublimated ink sheets because of their ink sheet manufacturing restrictions.

The color thermal printer according to the first embodiment of the invention is designed to rewind the ink sheet by a predetermined distance when the sensors have sensed a sensor mark and to start printing. Therefore, waste of the ink sheet for the predetermined distance between the heating body line of the thermal head and the sensors can be dispensed with, which in turn eliminates waste of the distance L between the thermal head of the ink sheet and the sensor block. As a result, the ink sheet roll diameter can be reduced, which contributes to downsizing the printer.

The color thermal printer according to the second embodiment of the invention is designed to sense a head colorant out of a set of colorants at a position to which the ink sheet has reached while further forwarded by a second predetermined distance by selecting a predetermined condition of combination of sensing operations by two sensors, which are the green light sensor and the red light sensor. Therefore, the sensor dedicated to reading the head color mark can be dispensed with, which in turn contributes to not increasing the number of sensors even if the number of recognition bits of the ID mark is increased due to an increase in the number of types of ink sheets. In addition, no head color mark is necessary for the ink sheet itself, which makes an ID mark the only sensor mark to be arranged at each boundary between colorants. As a result, the ink sheet fabricating process can be simplified.

The color thermal printer according to the third embodiment of the invention is designed to sense the head colorant by selecting a condition of combination of sensing results obtained by the red light sensor at the position to which the ink sheet has reached while forwarded by the second predetermined distance and at the position to which the ink sheet has reached while rewound by the third predetermined distance, the red light sensor being capable of sensing the yellow colorant as well as the cyan and the black colorants. Therefore, yellow can be judged by the only one sensor, the red light sensor.

The color thermal printer according to the fourth embodiment of the invention is designed so that a sensor mark is superposed on a part of a colorant on the ink sheet. Therefore, the ID mark can be sensed by the red light sensor at the same position as that at which the colorant shields or transmits light. This dispenses with the forwarding of the ink sheet by the second predetermined distance L2, and therefore, makes the operation simple.

What is claimed is:

1. A color thermal printer using an ink sheet having a set of three or four colorants coated or printed thereon so as to correspond to a print area and having sensor marks arranged at boundaries between the colorants, said color thermal printer comprising:

a plurality of sensors for sensing said sensor marks on said ink sheet, said plurality of sensors being disposed within a print width of a thermal head and located a predetermined distance downstream from a heat line of the thermal head;

means for rewinding the ink sheet by said predetermined distance when said sensors have sensed the sensor marks; and printing means for causing printing to be effected after said rewinding means have rewound said ink sheet by said predetermined distance.

2. The color thermal printer according to claim 1, wherein the sensor marks include an identification mark for sensing a head of each colorant and identifying a type of the ink sheet.

3. The color thermal printer according to claim 2, wherein the sensor marks further include a head color mark for sensing a head color out of the set of colorants.

4. The color thermal printer according to claim 1, wherein said plurality of sensors are linearly arranged such that the plurality of sensors are substantially parallel to the heat line of the thermal head.

5. A color thermal printer using an ink sheet having a set of three or four colorants coated or printed thereon so as to correspond to a print area and having sensor marks arranged at boundaries between the colorants, said color thermal printer comprising:

a plurality of sensors for sensing said sensor marks on said ink sheet, said plurality of sensors being disposed within a print width of a thermal head and located a first predetermined distance downstream from a heat line of the thermal head, said sensors including a green light sensor capable of sensing green light and a red light sensor capable of sensing red light;

means for further forwarding the ink sheet by a second predetermined distance when the green light sensor and the red light sensor have sensed the sensor marks;

head color detecting means for detecting a head color out of the set of colorants based upon sensing results obtained by the green light sensor and the red light sensor; and means for rewinding the ink sheet by a third predetermined distance upon detection of the head color and then causing printing to be effected, said third predetermined distance being obtained by adding the first predetermined distance to the second predetermined distance.

6. The color thermal printer according to claim 5, wherein the sensor marks include an identification mark for sensing a head of each colorant and identifying a type of the ink sheet.

7. The color thermal printer according to claim 5, wherein said plurality of sensors are linearly arranged such that the plurality of sensors are substantially parallel to the heat line of the thermal head.

8. A color thermal printer using an ink sheet having a set of three or four colorants selected from yellow, magenta, cyan, and black coated or printed thereon so as to correspond to a print area and having sensor marks arranged at boundaries between the colorants, said color thermal printer comprising:

first and second memories;

a plurality of sensors for sensing said sensor marks on said ink sheet, said plurality of sensors being disposed within a print width of a thermal head and located a first predetermined distance downstream from a heat line of the thermal head, said sensors including a red light sensor capable of sensing the yellow colorant as well as sensing the cyan and black colorants;

means for rewinding the ink sheet;

means for recording a first sensing result of the red light sensor in said first memory, said first sensing result being obtained at a position to which the ink sheet has been advanced upon being further forwarded by a second predetermined distance when said plurality of sensors have sensed the sensor marks;

means for recording a second sensing result of the red light sensor in said second memory, said second sensing result being obtained at a position to which the ink sheet has been transported after being rewound by a third predetermined distance, said third predetermined distance being obtained by adding the first predetermined distance to the second predetermined distance; and means for causing printing to be effected under a predetermined condition based upon recorded results in said first and second memories.

9. The color thermal printer according to claim 8, wherein the sensor marks include an identification mark for sensing a head of each colorant and identifying a type of the ink sheet.

10. The color thermal printer according to claim 8, wherein said plurality of sensors are linearly arranged such that the plurality of sensors are substantially parallel to the heat line of the thermal head.

11. A color thermal printer using an ink sheet having a set of three or four colorants selected from yellow, magenta, cyan, and black coated or printed thereon so as to correspond to a print area and having a sensor mark superposed on a portion of each colorant, said color thermal printer comprising:

first and second memories;

a plurality of sensors for sensing said sensor marks on said ink sheet, said plurality of sensors being disposed within a print width of a thermal head and located a predetermined distance downstream from a heat line of the thermal head, said sensors including a red light sensor capable of sensing the yellow colorant as well as sensing the cyan and black colorants;

means for rewinding the ink sheet;

means for recording a first sensing result of the red light sensor in said first memory, said first sensing result being obtained at the same position at which said plurality of sensors sense the sensor marks;

means for recording a second sensing result of the red light sensor in the second memory, the second sensing result being obtained at a position to which the ink sheet has been transported after being rewound by the predetermined distance; and means for causing printing to be effected under a predetermined condition based upon recorded results in said first and second memories.

12. The color thermal printer according to claim 11, wherein the sensor marks includes an identification mark for sensing a head of each colorant and identifying a type of the ink sheet.

13. The color thermal printer according to claim 11, wherein said plurality of sensors are linearly arranged such that the plurality of sensors are substantially parallel to the heat line of the thermal head.

* * * * *